United States Patent [19]

Poling

[11] Patent Number: 4,875,289

[45] Date of Patent: Oct. 24, 1989

[54] CHISEL FOR REMOVING DAMAGED BOLTS, NUTS AND SCREWS

[76] Inventor: Denzil C. Poling, Rte. 6, Box 80, Hagerstown, Md. 21740

[21] Appl. No.: 177,145

[22] Filed: Apr. 4, 1988

[51] Int. Cl.[4] ..... B26B 3/00

[52] U.S. Cl. ..... 30/167; 30/168; 81/53.2

[58] Field of Search ..... 30/167, 168; 81/53.2

[56] References Cited

U.S. PATENT DOCUMENTS

| | | | |
|---|---|---|---|
| 906,040 | 12/1908 | Lucas . | |
| 975,677 | 11/1910 | Clark | 30/168 |
| 1,004,193 | 9/1911 | Plaisted | 30/167 |
| 1,020,040 | 3/1912 | Jenkins . | |
| 1,041,440 | 10/1912 | Decker . | |
| 1,093,255 | 4/1914 | Carnes . | |
| 1,179,680 | 4/1916 | Tallyn . | |
| 1,598,458 | 8/1926 | Sullivan . | |
| 1,785,847 | 12/1930 | Valentine . | |
| 2,622,466 | 12/1952 | Vanden Bos et al. . | |
| 2,750,821 | 6/1965 | Hilsinger . | |
| 4,144,868 | 3/1979 | Heitbrink | 30/168 |
| 4,713,990 | 12/1987 | Poling . | |

*Primary Examiner*—Frederick R. Schmidt
*Assistant Examiner*—Maurina Rachuba
*Attorney, Agent, or Firm*—Bernard, Rothwell & Brown

[57] ABSTRACT

A chisel for rotationally disengaging a threaded bolt, nut or screw, has at one end thereof a cutting edge for cutting into and penetrating a surface of the bolt. The chisel further includes a first chisel face terminating at the cutting edge of the chisel, and a stop face positioned away from the cutting edge with the first chisel face disposed between the stop face and the cutting edge. The stop face is at an angle of about 90 degrees or less with respect to the first chisel face. The cutting edge has a width that is about equal to or greater than the distance between the stop face and the cutting edge. The stop face prevents further penetration of the cutting edge into the bolt beyond the stop face so as to provide for application of rotational force to the bolt by the chisel without further penetration of the cutting edge into the bolt.

21 Claims, 3 Drawing Sheets

CHISEL FOR REMOVING DAMAGED BOLTS, NUTS AND SCREWS

BACKGROUND OF THE INVENTION

1. Field of the Invention

The present invention relates to a device for extracting damaged bolts, nuts, screws and the like, that cannot be removed with ordinary tools.

2. Description of the Background Art

The extraction of bolts and nuts with rounded or broken heads using a hammer and an ordinary chisel is generally known to persons involved in repairing machinery and the like.

Typically, a chisel is placed against the side or edge of a bolt and a hammer is used to drive the cutting edge of the chisel into the bolt to impart rotational force. If the bolt is rusted or torqued to a high degree the chisel will cut into the bolt too far and will simply slice away the edge of the bolt and send the cut material flying. Mechanics often try to avoid this by switching to a chisel with a dull or blunted edge before the cut is too deep. This maneuver is sometimes successful if the bolt is not overly tight. However, the blunted edge of this chisel will spread the kerf made by the original chisel and eventually spread away and slice off the outer edge of the bolt creating a potentially dangerous missile if rotation of the bolt is not accomplished. If the broken fragment leaves a bench or shoulder on the bolt, the mechanic might try holding a punch against the shoulder in an attempt to achieve rotation without further damage to the bolt head or nut. Holding a flat punch against the shoulder and coordinating hammer blows to impart rotational force requires considerable skill, and not all mechanics possess this skill. Frequently, too much attention is paid to one end of the chisel and it is not uncommon to strike the hand holding the chisel with the hammer, or allow the working end of the chisel to slip off the bolt.

Bolts that have broken off at or near the surface of the threaded body are also a common problem encountered by mechanics repairing machinery. To avoid further drilling and using a screw extractor the repairman will frequently try hammering a small chisel or punch into the outer edge of the broken bolt at an angle that will impart some rotational force. However, if the bolt is rusted or tightly threaded the chisel or punch will penetrate deeply into the bolt and expand the material of the bolt tightly against the tapped threads. Further hammering will only cause additional expansion of the bolt and may damage the tapped threads in the body.

In view of the above problem and in the interest of safety and expediency, a specialized tool is needed for removal of damaged bolts and nuts.

SUMMARY OF THE INVENTION

In accordance with the present invention, a device for rotationally disengaging a first threaded member from a second threaded member engaged therewith comprises a chisel having at one end thereof a cutting edge for cutting into and penetrating a surface of the first threaded member. The chisel further includes a first chisel face, one side of which is defined by the cutting edge, and a stop face positioned away from the cutting edge, with the first chisel face disposed between the stop face and the cutting edge. The stop face is at an angle with respect to the first chisel face of about 90° or less. The cutting edge has a width that is about equal to or greater than the distance between the stop face and the cutting edge. The stop face prevents further penetration of the cutting edge into the first threaded member beyond the stop face so as to provide for application of rotational force to the first threaded member by the chisel without further penetration of the cutting edge into the first threaded member.

DETAILED DESCRIPTION OF THE PREFERRED EMBODIMENTS

Figure 1:
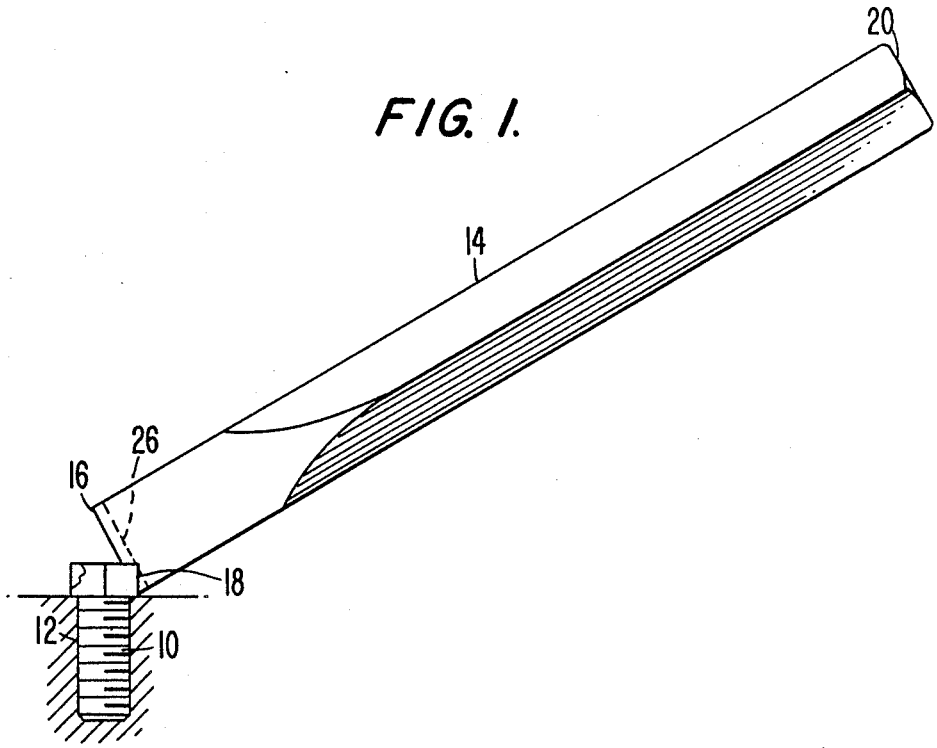
FIG. 1 is a side elevation view, partly schematic, showing a chisel with an inverted stop in accordance with the present invention, embedded into the side of a bolt.

As shown in FIG. 1, the present invention provides a device for rotationally disengaging a first threaded member, such as bolt 10, from a second threaded member 12 engaged therewith.

The device is comprised of a chisel 14 having at one end thereof a cutting edge 16 for cutting into and penetrating a surface of the head 18 of bolt 10 by hammering end 20 of chisel 14.

Figure 3:
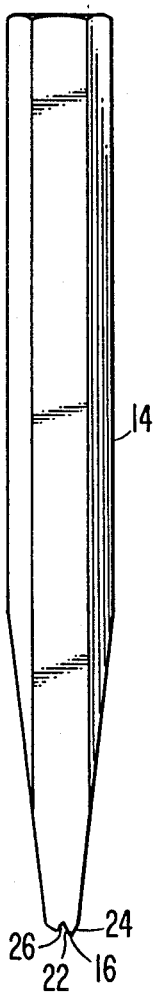
FIG. 3 is a side elevation view of the chisel shown in FIG. 1, but a right angle thereto.
Figure 4:
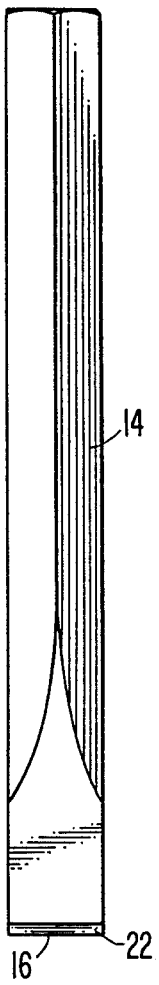
FIG. 4 is another side elevation view of the chisel shown in FIG. 1.

With reference to FIGS. 3 and 4, the chisel 14 includes a first chisel face 22, one side of which is defined by cutting edge 16, and a second chisel face 24 that forms an acute angle with the first chisel face 22 to form a chisel point. In particularly preferred embodiments, the second chisel face 24 is at an angle with respect to the first chisel face 22 of about 60° or less to form the chisel point.

The chisel of the present invention includes a unique inverted stop face 26 that is positioned away from cutting edge 16, with the first chisel face 22 disposed between the stop face 26 and the cutting edge 16. In the embodiments shown, the first chisel face and the stop face are planar and their planes intersect with each other.

As shown in FIG. 3, the stop face 26 meets the first chisel face 22 and is continuous therewith. Stop face 26 is at an angle with respect to the first chisel face 22 of less than about 90°, and a comparison of FIGS. 3 and 4 reveals that the cutting edge 16 has a width that is greater than the distance between stop face 26 and cutting edge 16.

The unique stop face 26 of the present invention prevents further penetration of the cutting edge 16 into the head 18 of bolt 10 beyond the stop face 26 during hammering of the chisel, so as to provide for application of rotational force to the bolt 10 by subsequent hammering of the chisel, without further penetration of the cutting edge into the first threaded member and without further destruction to the bolt head.

Further penetration of the cutting edge into the bolt head beyond the stop face is prevented by having the stop face angled about 90° or less with respect to the first chisel face, and by providing the cutting edge with a width that is about equal to or greater than the distance between the stop face and the cutting edge. If the angle between the stop face and the first chisel face is greater than about 90°, the stop face does not act as a stop, but rather continues to plow up metal as the chisel is hammered into the bolt head. Also, if the cutting edge of the chisel has a width that is less than the distance between the stop face and the cutting edge, the stop face will not prevent the chisel from further penetrating and gouging into the bolt head. Such additional penetration of the chisel into the bolt head does not permit application of the large amount of rotational force that can be applied by hammering the chisel of the present invention.

According to one embodiment, the stop face is at an angle with respect to the first chisel face of between about 60°–90°. In preferred embodiments, the stop face is at an angle with respect to the first chisel face of between about 45°–80°.

The dimensional difference between the width of the cutting edge and the distance between the stop face and the cutting edge can be varied, depending upon the size and type of bolt, screw or nut being removed. For some smaller screws and nuts, the width of the cutting edge can be equal to or only slightly greater than the distance between the stop face and the cutting edge. For other screws, nuts or bolts, the cutting edge is at least about 1½ times greater than the distance between the stop face and the cutting edge, and can be at least about two, three, four, five and even six or more times greater than the distance between the stop face and the cutting edge.

Proper utilization of a chisel as illustrated in FIG. 1 requires only that the user place the cutting edge 16 of chisel 14 against the outer edge of the damaged bolt head 18, and deliver hammer blows to the end 20 of chisel 14 until the cutting edge 16 enters the bolt the depth of the inverted stop face 26. Stop face 26 will prevent further penetration of cutting edge 16, and the force of further hammer blows will be directed entirely onto the side of the bolt head 18. At this point, heavy hammer blows can be delivered to end 20 of chisel 14 without fear of either cutting away a portion of the bolt head 18 or of having the cutting edge 16 bounce off the side of bolt head 18. Because the full force of the hammer blows are being delivered to the side of bolt head 18 without additional cutting, all of the force of the hammer blows is being directed towards rotation of the bolt. The slot in the bolt head 18 made by cutting edge 16 greatly facilitates holding the chisel 14 against the bolt head 18 such that the user can pay particular attention to striking the chisel 14 at end 20 and freeing the bolt. Depending on the location of the bolt being removed, the chisel need not be angled as shown in FIG. 1, but can be positioned more perpendicular to the axis of the bolt. Under some circumstances, a power hammer can be utilized to engage and apply force to end 20 of the chisel, rather than applying manual hammer blows.

Figure 2:
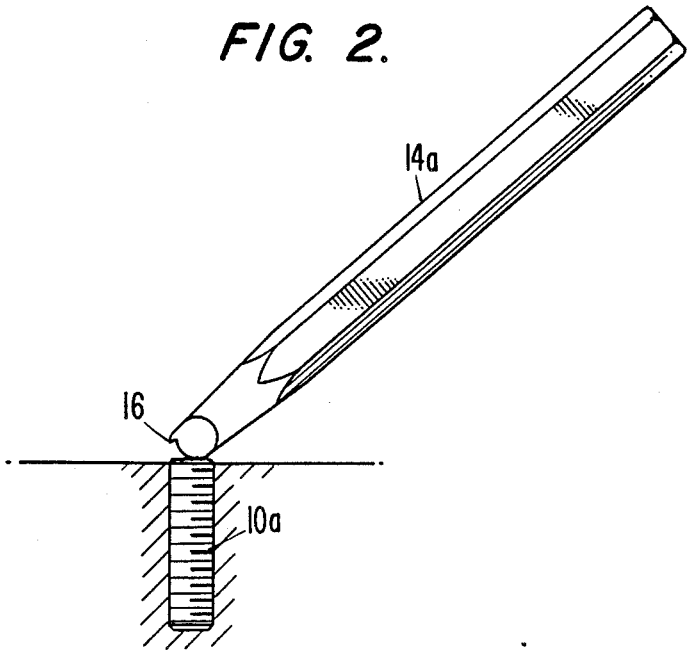
FIG. 2 is a side elevation view, partly schematic, showing another embodiment of a chisel according to the invention, embedded into the top of a broken bolt.
Figure 5:
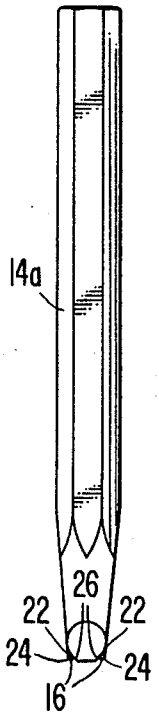
FIG. 5 is a side elevation view of the chisel shown in FIG. 2.
Figure 6:
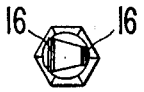
FIG. 6 is an end elevation view of the chisel shown in FIG. 5.

In the embodiment shown in FIGS. 5 and 6, a chisel **14*a* according to the invention includes two cutting edges 16 of different widths for freeing bolts, screws or nuts of different sizes. As shown in FIG. 5, each of the cutting edges is associated with a separate first chisel face 22, as defined above, and each of the cutting edges has a separate stop face 26 associated therewith. In the embodiment shown in FIG. 2, the chisel 14*a* illustrated in FIG. 5 and 6 is used to extract a bolt 10*a* broken off at or near the surface. According to this embodiment, a cutting edge of the chisel is driven into the exposed edge of the damaged bolt 10*a*** at an angle, until the chisel reaches the stop face and does not penetrate any further. Additional hammer blows apply rotational force to the damaged bolt without additional penetration and without further expansion of the bolt.

Figure 7:
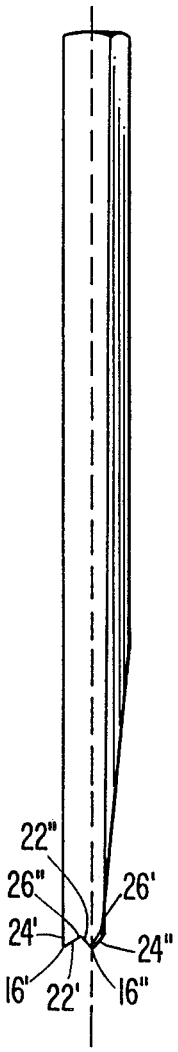
FIG. 7 is a side elevation view showing yet another embodiment of a chisel having an inverted stop according to the present invention, the chisel having two cutting edges, each of which have a first chisel face that forms the stop face for the cutting edge of the other chisel face, wherein a second chisel face extending from one of the cutting edges is in a plane that is parallel to the chisel axis.
Figure 8:
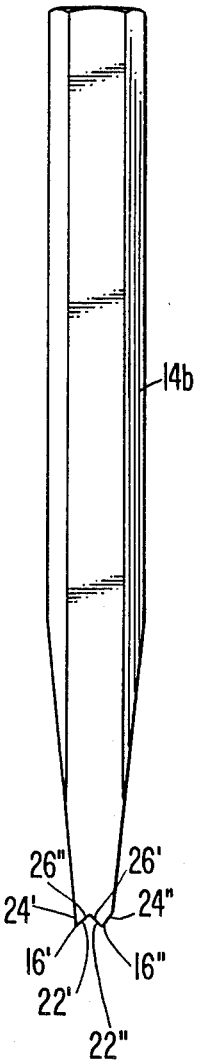
FIG. 8 is a side elevation view showing still another embodiment of a chisel according to the invention having two cutting edges, each having a first chisel face that forms the stop face for the cutting edge of the other chisel face.

FIGS. 7 and 8 illustrate chisels according to the present invention having a pair of cutting edges 16' and 16'' each having a first chisel face 22' and 22'' respectively associated therewith. Each of the cutting edges 16' and 16'' further has a second chisel face 24' and 24'' respectively associated therewith.

According to the embodiment shown in FIGS. 7 and 8, each of the first chisel faces 22' and 22'' forms the respective stop face 26' and 26'' of the respective chisel faces 22' and 26''. In these embodiments, the distance between cutting edge 16' and its respective stop face 26' differs from the distance between the other cutting edge 16'' and its respective stop face 26''.

In the embodiment shown in FIG. 7, the second chisel face 24' associated with cutting edge 16' is parallel to the chisel axis, whereas in FIG. 8, chisel face 24' is slightly angled with respect to the chisel axis.

It can be seen that the present invention provides an easy to use device that eliminates many of the problems previously associated with removing damaged bolts and nuts.

Since some modifications, variations and changes in detail can be made to the described embodiment, it is intended that all matter in the foregoing description and shown in the accompanying drawing be interpreted as illustrative and not in a limiting sense.

I claim:

1. A device for rotationally disengaging a first threaded member from a second threaded member engaged therewith, comprising a chisel having at one end thereof a cutting edge for cutting into and penetrating a surface of the first threaded member, the chisel further including a first chisel face, one side of which is defined by said cutting edge, and a stop face positioned away from the cutting edge wherein said stop face meets the first chisel face and is continuous with said first chisel face, said first chisel face being disposed between the stop face and the cutting edge, the stop face being at an angle with respect to said first chisel face of about 90 degrees or less, said cutting edge having a width that is about equal to or greater than the distance between said stop face and said cutting edge, the stop face preventing further penetration of the cutting edge into the first threaded member beyond the stop face so as to provide for application of rotational force to the first threaded member by the chisel without further penetration of the cutting edge into the first threaded member.

2. The device of claim 1 further including a second chisel face, one side of which is defined by said cutting edge, the second chisel face forming an acute angle with said first chisel face.

3. The device of claim 2 wherein the second chisel face is at an angle with respect to said first chisel face of about 60 degrees or less.

4. The device of claim 2 wherein said chisel has an axis and wherein said second chisel face is in a plane that is parallel to said axis.

5. The device of claim 1 including two of said cutting edges, each having a first chisel face associated therewith, wherein the first chisel face associated with one of said cutting edges forms the stop face of the other of said cutting edges.

6. The device of claim 5 further including a separate second chisel face terminating at each of said two cutting edges, each second chisel face being at an angle of about 60 degrees or less in relation to it's respective first chisel face.

7. The device of claim 6 wherein said chisel has an axis and wherein at least one of said second chisel faces is in a plane that is parallel to said axis.

8. The device of claim 5 wherein said cutting edges are of different widths.

9. The device of claim 5 wherein the distance between one of said cutting edges and its respective stop face differs from the distance between the other of said cutting edges and its respective stop face.

10. The device of claim 1 including two of said cutting edges, each having a separate stop face associated therewith.

11. The device of claim 1 wherein said first chisel face is planar, and said stop face is planar and intersects said first chisel face.

12. The device of claim 1 wherein the width of said cutting edge is at least about 1½ times greater than the distance between said stop face and said cutting edge.

13. The device of claim 1 wherein the width of said cutting edge is at least about 2 times greater than the distance between said stop face and said cutting edge.

14. The device of claim 1 wherein the width of said cutting edge is at least about 3 times greater than the distance between said stop face and said cutting edge.

15. The device of claim 1 wherein the width of said cutting edge is at least about 5 times greater than the distance between said stop face and said cutting edge.

16. The device of claim 1 wherein the width of said cutting edge is at least about 6 times greater than the distance between said stop face and said cutting edge.

17. The device of claim 1 wherein the width of said cutting edge is at least about 6 times greater than the distance between said stop face and said cutting edge.

18. The device of claim 1 wherein said chisel has an end opposite the cutting edge for receiving manual hammering.

19. The device of claim 1 wherein said chisel has an end opposite the cutting edge for engaging a power hammer.

20. The device of claim 1 wherein said stop face is at an angle with respect to said first chisel face of between about 60–90 degrees.

21. The device of claim 1 wherein said stop face is at an angle with respect to said first chisel face of between about 45–80 degrees.

* * * * *

UNITED STATES PATENT AND TRADEMARK OFFICE

CERTIFICATE OF CORRECTION

PATENT NO. : 4,875,289

DATED : October 24, 1989

INVENTOR(S) : Denzil C. POLING

It is certified that error appears in the above-identified patent and that said Letters Patent is hereby corrected as shown below:

Claims:

Column 6, line 14, "5" should be -- 4 --;

Column 6, line 17, "6" should be -- 5 --.

Signed and Sealed this

Fourth Day of June, 1991

*Attest:*

HARRY F. MANBECK, JR.

*Attesting Officer*

*Commissioner of Patents and Trademarks*